US011007110B1

(12) United States Patent
Zhou et al.

(10) Patent No.: US 11,007,110 B1
(45) Date of Patent: May 18, 2021

(54) AIR PRESSURE MASSAGER

(71) Applicants: SHENZHEN ZHUOLE E-COMMERCE CO., LTD., Shenzhen (CN); DONGGUAN AISI HEALTH PRODUCTS CO., LTD., Dongguan (CN)

(72) Inventors: Dan Zhou, Shenzhen (CN); Biao Zhou, Gao'an (CN)

(73) Assignees: SHENZHEN ZHUOLE E-COMMERCE CO., LTD., Shenzhen (CN); DONGGUAN AISI HEALTH PRODUCTS CO., LTD., Dongguan (CN)

( * ) Notice: Subject to any disclaimer, the term of this patent is extended or adjusted under 35 U.S.C. 154(b) by 0 days.

(21) Appl. No.: 17/090,839

(22) Filed: Nov. 5, 2020

(30) Foreign Application Priority Data

Oct. 21, 2020 (CN) ..... 202022353395.7

(51) Int. Cl.
*A61H 9/00* (2006.01)
*A61H 23/02* (2006.01)
*A61H 19/00* (2006.01)

(52) U.S. Cl.
CPC ..... *A61H 9/0007* (2013.01); *A61H 9/0057* (2013.01); *A61H 9/0071* (2013.01); *A61H 23/0263* (2013.01); *A61H 19/30* (2013.01); *A61H 19/34* (2013.01); *A61H 2009/0064* (2013.01); *A61H 2201/0153* (2013.01); *A61H 2201/1688* (2013.01)

(58) Field of Classification Search
CPC .. A61H 9/0007; A61H 9/0071; A61H 9/0057; A61H 23/0263; A61H 19/34; A61H 19/30; A61H 2201/1688; A61H 2009/0064; A61H 2201/0153
See application file for complete search history.

(56) References Cited

U.S. PATENT DOCUMENTS

2016/0213557 A1* 7/2016 Lenke ..... A61H 23/0245
2017/0281457 A1* 10/2017 Witt ..... A61H 9/0007
2019/0015291 A1* 1/2019 Sedic ..... A61H 23/02
2019/0083354 A1* 3/2019 Pahl ..... A61H 9/0007

* cited by examiner

*Primary Examiner* — Quang D Thanh

(57) ABSTRACT

An air pressure massager includes at least one pressure field generating device. The pressure field generating device includes a chamber with at least one first opening, a connecting rod member connected to one end of the chamber, an eccentric member connected to the connecting rod member, a driving unit connected with the eccentric member, a control device configured to activate the drive unit, and an accessory. The first opening is configured to be placed on a portion of a human body. The driving unit drives the eccentric member to move to drive the connecting rod member to move, such that a volume of the chamber is changed to generate a pressure field for stimulating the human body. The pressure field generated in the chamber directly towards the portion of the human body. The pressure field is adjusted by a positive pressure mode and/or a negative pressure mode.

20 Claims, 7 Drawing Sheets

AIR PRESSURE MASSAGER

TECHNICAL FIELD

The present disclosure relates to a field of massager technology, and in particular to an air pressure massager.

BACKGROUND

The air pulse sucking type massager is an appliance configured to stimulate sensitive portions of a human body. A driving system of the air pulse sucking type massager changes a volume of a first chamber and generates a pressure field in a second chamber through a connecting element where the second chamber contacts the human body, thereby achieving a stimulating effect.

A conventional air pulse massager generally adopts a direct current (DC) motor (a driving unit), an eccentric cam, and a connecting rod to change the volume of the first chamber. Then a pressure field is generated in the second chamber via a connecting piece to stimulate the human body. In this solution, there are unavoidable gaps between the first chamber and a connector, and the connecting piece and the second chamber. The air pulse massager often contacts the human body, and body fluid would enter the first chamber, the connecting piece, the second chamber, and the unavoidable gaps. Thus, there is a problem that it is difficult to clean the gaps, which breeds bacteria. Moreover, there is also a hidden danger of waterproofing in the gaps. In addition, the pressure field generated in the second chamber has a loss when a pressure difference generated by the volume change of the first chamber is transmitted through the connecting piece to generate the pressure field, which affects the final effect.

In summary, the above-mentioned air pulse massager has a complex structure, is difficult to assemble, and is difficult for users to clean.

SUMMARY

Therefore, in view of the above-mentioned problems, a purpose of the present disclosure is to provide an air pressure massager with a simple structure, convenient and safe assembly, and good stimulation effect.

To achieve the above object, the present disclosure provides an air pressure massager. The air pressure massager comprises at least one pressure field generating device. The pressure field generating device comprises a chamber with at least one first opening, a connecting rod member connected to one end of the chamber, an eccentric member connected to the connecting rod member, a driving unit in a transmission connection with the eccentric member, a control device configured to activate the drive unit, and an accessory. The first opening is configured to be placed on a portion of a human body. The driving unit drives the eccentric member to move to drive the connecting rod member to move, such that a volume of the chamber is changed to generate a pressure field for stimulating the human body. The pressure field generated in the chamber directly towards the portion of the human body. The pressure field is adjusted by a positive pressure mode and/or a negative pressure mode.

In the context of the present disclosure, the pressure field is a medium pressure field that changes with time and has a temporary positive pressure and a temporary negative pressure. The negative pressure is a medium pressure lower than a reference pressure and the positive pressure is a medium pressure higher than the reference pressure. pressure. As a result, the medium flows back and forth in the pressure field of the present disclosure. Therefore, optionally, the medium is exchanged intermittently to a large extent The medium is generally gaseous, optionally, air, but the medium is alternatively or additionally, a liquid medium such as water or a commercially available lubricant. For example, before using the air pressure massager, the chamber of the present disclosure may be filled with lubricant. The chamber is also allowed to be filled with suitable skin-friendly liquids instead of air to stimulate the corresponding areas of the human body, which is chosen according to personal preferences of a user. As a further example, the air pressure massager may also be used underwater with water as the medium (for example, in a bathtub). In this embodiment, the air pressure massager is waterproof When the air pressure massager is turned on (ie, before placing the air pressure massager on the skin area to be stimulated), the reference pressure is usually the atmospheric pressure acting on the air pressure massager. In one embodiment that the air pressure massager is applied, the reference pressure is currently prevailing air pressure or normal pressure. For example, when the air pressure massager is applied under normal standard conditions, the reference pressure may be approximately 1 bar. When the air pressure massager is turned on, the negative pressure generated by the present disclosure, for example, is 0.7 bar, and the positive pressure generated by the present disclosure, for example, is 1.3 bar.

The pressure field generated by the present disclosure is, on the one hand, configured to promote blood circulation of the skin area to be stimulated, while on the other hand, configured to indirectly massage the skin area. The present disclosure combines two advantages of promoting the blood circulation and massage. When the air pressure massager is placed on a user's erogenous zone, the air pressure massager promotes blood circulation, making the user's erogenous zone sensitive, while the air pressure massager also has a massage function, which is configured to stimulate the erogenous zone, for example, to arouse the sex until orgasm. The massage function is generated by kinetic energy of the medium flowing from the first chamber, passing through the connecting rod member, and against a surface of the skin area to be stimulated. In this way, the massage function generated by the pressure field is produced indirectly, that is, the skin area to be stimulated does not need to be in direct contact with a vibration generating portion of the air pressure massager.

Regarding an exemplary application of the time-variable pressure field to user's clitoris according to the present disclosure, the pressure field mimics the stimulating effect that normally occurs during sexual communication. Moreover, sexual intercourse during the use of the air pressure massager will also produce different clitoral stimulation Therefore, use of the air pressure massager is a realistic imitation of natural behavior of sexual intercourse. Further, medical findings confirm that the application of the pressure field of the present disclosure neither causes habitual effects nor addiction. Specifically, this is because of the alternating application of negative pressure and positive pressure (or actually because there is only one type of discontinuous application of pressure).

Furthermore, a maximum applicable pressure is usually limited by a maximum load that may be placed on the skin area to be stimulated. If the negative pressure applied to the erogenous zone is two high, there is a risk of causing painful damage. As a result, air pressure massage devices that only work with negative pressure are usually limited to the maximum load in their operating mode. In contrast, in the air pressure massager disclosed in the present disclosure, a combination of positive pressure and negative pressure forms an extended operating range of the pressure field or effect induced by stimulation, since operating ranges of the positive pressure and the negative pressure are both used up to the maximum value.

In one embodiment, the air pressure massager further comprises a housing. The housing comprises a second opening. A main body of the chamber extends into the housing through the second opening of the housing.

In one embodiment, the first opening of the chamber is disposed in the second opening of the housing.

In one embodiment, the driving unit comprises a first motor fixedly disposed in the housing and a power source fixedly disposed in the housing. The power source is connected to the first motor. Output shafts disposed on two ends of the first motor are in the transmission connection with the eccentric member.

In one embodiment, the eccentric member comprises eccentric wheels and perforated rubber rods. One end of each eccentric wheel is connected to a corresponding output shaft disposed on one end of the first motor. One end of each perforated rubber rod is connected to another end of each eccentric wheel. Another end of each perforated rubber rod is connected to the connecting rod member.

In one embodiment, the connecting rod member comprises a U-shaped rod and a T-shaped rod.

Two ends of the U-shaped rod are separately connected to a corresponding perforated rubber rod.

The T-shaped rod is disposed on the U-shaped rod; a front end of the T-shaped rod is connected to the chamber.

In one embodiment, the driving unit comprises a second motor and a power source. The second motor is fixedly disposed in the housing. The power source is fixedly disposed in the housing. The power source is connected to the second motor. An output shaft of the second motor is in the transmission connection with the eccentric member.

In one embodiment, the eccentric member comprises an eccentric wheel and a perforated rubber rod. One end of the eccentric wheel is connected to the output shaft of the second motor. One end of the perforated rubber rod is connected to another end of the eccentric wheel. Another end of the perforated rubber rod is connected to the connecting rod member.

In one embodiment, the connecting rod member is a T-shaped rod. A front end of the T-shaped rod is connected to the chamber.

In one embodiment, the air pressure massager further comprises charging nails. The charging nails are disposed in a lower portion of the housing and are connected to a power source.

In one embodiment, the power source is a battery.

In one embodiment, the air pressure massager further comprises a bracket. The drive unit and the eccentric member are disposed on the bracket.

In one embodiment, the air pressure massager further comprises an electroplating decoration piece. The electroplating decoration piece is disposed under the housing and is buckled with the housing.

In one embodiment, the air pressure massager is a handheld device.

In one embodiment, the chamber is made of flexible material and/or is made of at least partially transparent material. The chamber is selected from a labia minora shaped chamber so that a labia minora of the human body is completely covered by the first opening.

In one embodiment, a rubber sleeve is sleeved on the housing.

In one embodiment, the rubber sleeve is integrally connected with the chamber.

In one embodiment, the rubber sleeve comprises an auxiliary stimulation structure on an outer periphery of the first opening.

In one embodiment, the auxiliary stimulation structure is one or more layers of petal-shaped structures formed on the outer periphery of the second opening.

In one embodiment, the chamber and the connecting rod member are made in one piece.

In one embodiment, the chamber is replaceable.

The present disclosure further provides an air pressure massage system. The air pressure massage system comprises an air pressure massager and a remote control device. The remote control device is disposed separately from the air pressure massager. The control device of the air pressure massager is remotely controlled by the remote control device. The air pressure massage system adopts a conventional wireless (for example, via radio) or wired remote controller, so that other users are able to remotely control the air pressure massager or turn on the air pressure massager.

The present disclosure further provides a method for stimulating a portion of a human body based on an air pressure massager. The method for stimulating the portion of the human body based on the air pressure massager comprises steps:

- placing a chamber of the air pressure massager on the portion of the human body;
- generating a pressure field directly towards the portion of the human body; and
- adjusting the pressure field in a positive pressure mode or a negative pressure mode.

The present disclosure further provides an application of an air pressure massager. The air pressure massager is used as a sex toy for stimulating female clitoris. As mentioned above, the female clitoris is a particularly sensitive erogenous zone for women. This is why the combination of indirect massage stimulation and negative pressure stimulation applied to the body portion to stimulate until orgasm is particularly advantages according to the application of the air pressure massager of the present disclosure.

In the present disclosure, the method for stimulating the portion of the human body is used for sexual pleasure, so the method is not used for medical treatment such as therapeutic purposes.

The above-mentioned features and functions as well as further aspects and features of the present disclosure will be further described below with reference to detailed description of optional embodiments and the accompanying drawings.

Compared with the prior art, in the present disclosure, the eccentric member is driven by the driving unit to drive the connecting rod member to move to change the volume of the chamber, so that the pressure field is generated by change of the volume of the chamber for stimulating the human body. There is no gap between the chamber and the connecting rod member, which is convenient for cleaning and maintenance, and solves the hygiene problem. The single chamber ensures an integrity of the structure, thereby improving an overall waterproof performance. The pressure field generated by the single chamber is configured to directly act on the human body, and there is no intermediate conduction energy loss, such that an excellent experience is obtained.

1—air pressure massager; 2—pressure field generating device; 3—chamber; 4—eccentric member; 5—connecting rod member; 6—driving unit; 7—control device; 8—housing; 9—wall of the chamber; 10—bracket; 11—portion of human body; 12—clitoris; 13—rubber sleeve; 14—auxiliary stimulation structure; 15—petal-shaped structures; 16—charging nail; 17—electroplating decoration piece; 18—accessory; 19—remote control device; 31—first opening; 41—eccentric wheel; 42—perforated rubber rod; 51—U-shaped rod; 52—T-shaped rod; 61—first motor; 62—power source; 63—second motor; 71—control board; 72—switch; 81—lower housing; 82—upper housing; and 83—second opening.

DETAILED DESCRIPTION

In order to make the objectives, technical solutions and advantages of the present disclosure clear, the following further describes the present disclosure in detail with reference to the accompanying drawings and embodiments. It should be understood that the specific embodiments described herein are only used to explain the present disclosure, but not to limit the present disclosure.

Figure 1:
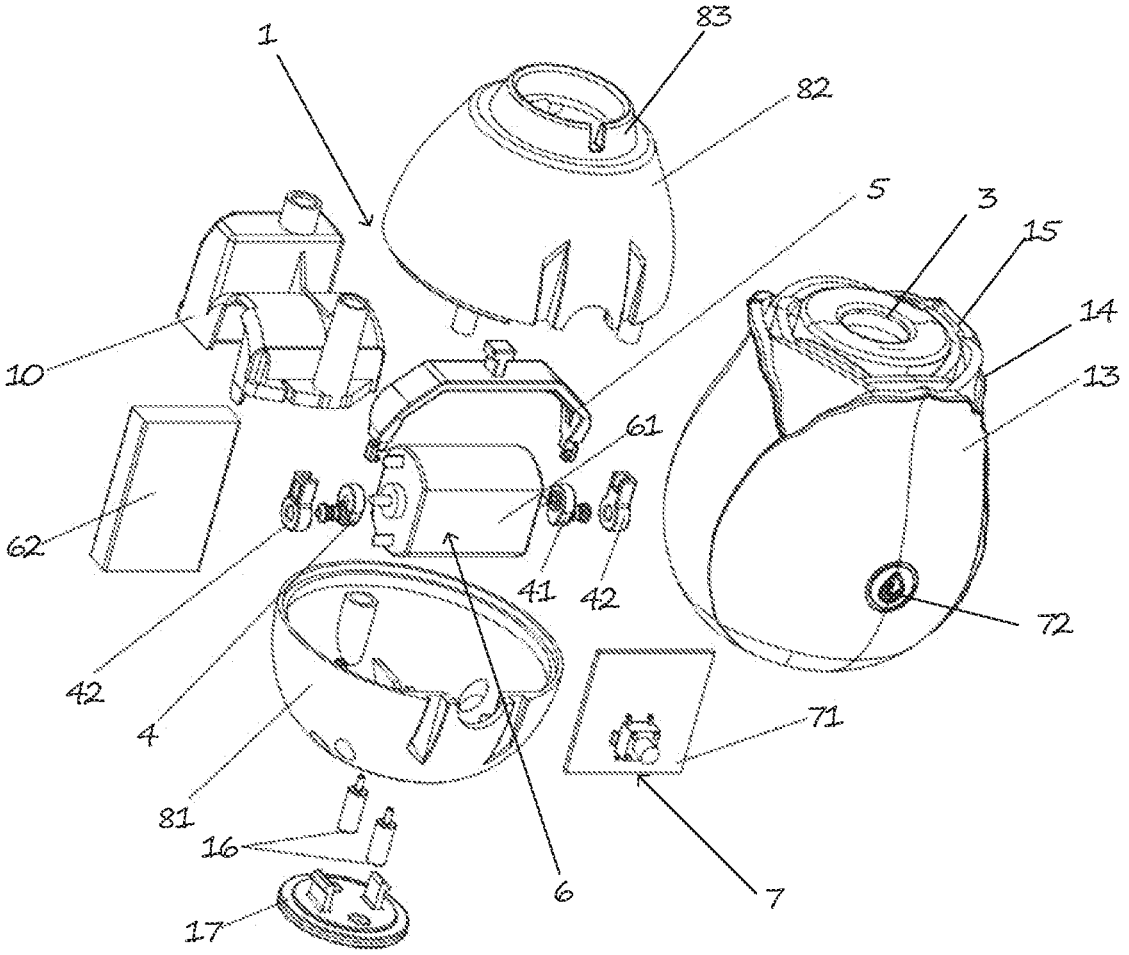
FIG. 1 is a n exploded view of a first embodiment of an air pressure massager of the present disclosure.
Figure 2:
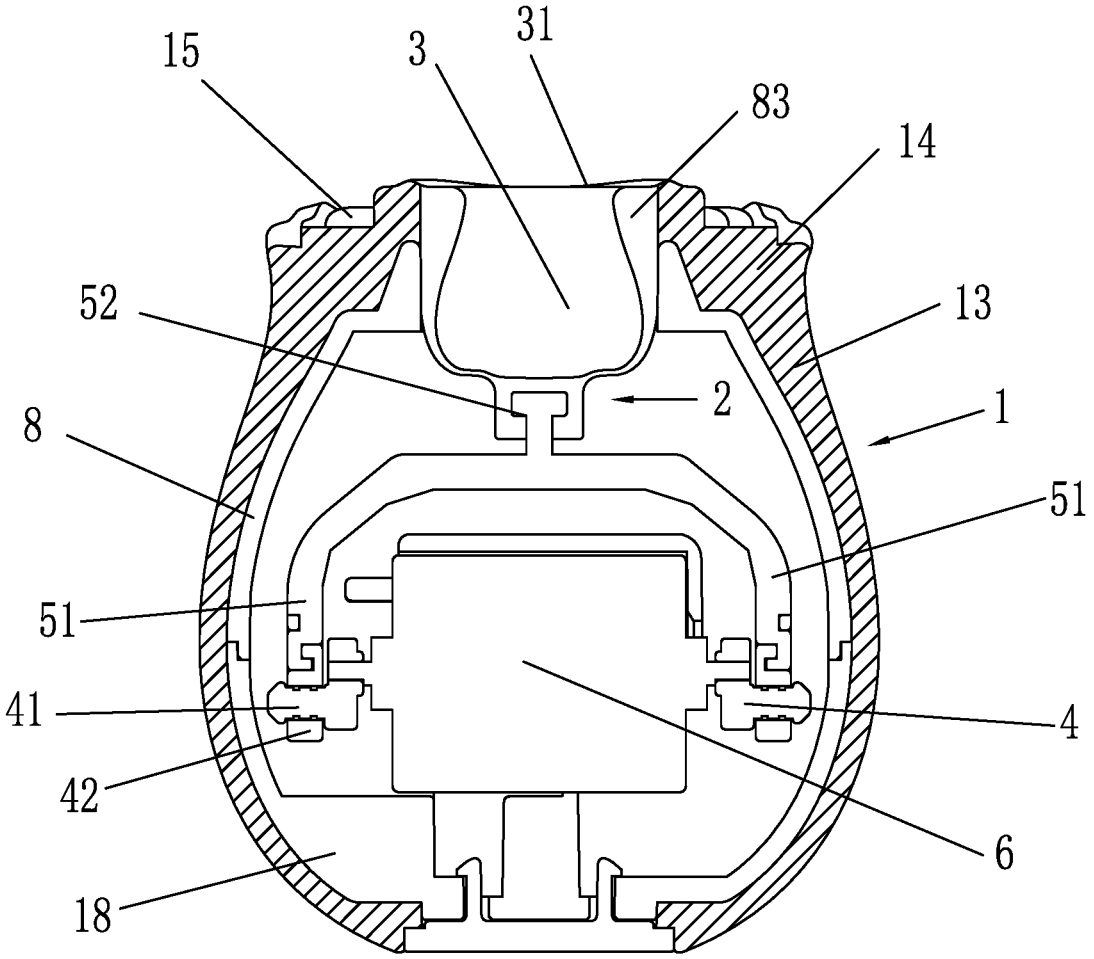
FIG. 2 is a cross-sectional view of the first embodiment of the air pressure massager of the present disclosure.
Figure 3:
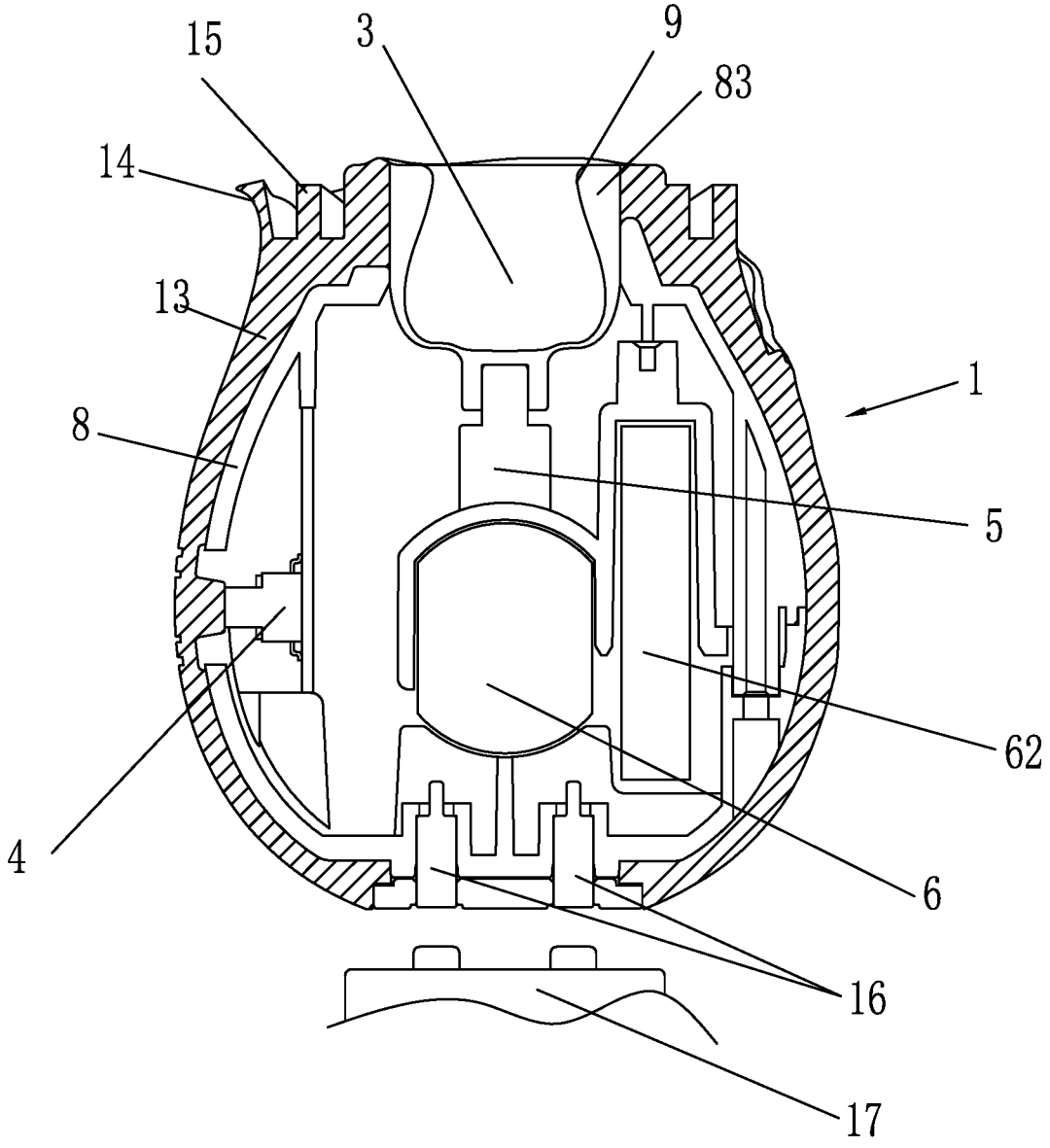
FIG. 3 is a cross-sectional view of the first embodiment of the air pressure massager of the present disclosure.

The first embodiment of the air pressure massager of the present disclosure will be illustrated with reference to FIGS. 1-3. FIG. 1 is a n exploded view of a first embodiment of an air pressure massager of the present disclosure. FIG. 2 is a cross-sectional view of the first embodiment of the air pressure massager of the present disclosure. FIG. 3 is a cross-sectional view of the first embodiment of the air pressure massager of the present disclosure.

The first embodiment of the air pressure massager 1 is optionally, a portable electrical device or a small device, which comprises a housing 8, a pressure field generating device 2, and a switch 72.

Optionally, the switch 72 is configured to turn on and turn off the air pressure massager 1. The switch 72 may be, for example, a button controlled to turn on or off the air pressure massager 1, or a lock sliding switch. Alternatively, it is possible to turn on and turn off the air pressure massager 1 by remote control.

The pressure field generating device of the first embodiment comprises a chamber 3 of the air pressure massager. The chamber 3 comprises at least one first opening 31 configured to be placed on a portion of a human body 11, a connecting rod member 5 connected to one end of the chamber 3, an eccentric member 4 connected to the connecting rod member 5, a driving unit 6 in a transmission connection with the eccentric member 4, a control device configured to activate the drive unit 7, and an accessory 18. The driving unit 6 drives the eccentric member 4 to move to drive the connecting rod member 5 to move, such that a volume of the chamber is changed to generate a pressure field for stimulating the human body. The pressure field generated in the chamber 3 directly towards the portion of the human body. The pressure field is adjusted by a positive pressure mode and/or a negative pressure mode.

For example, the driving unit 6 may be an electric motor, and the driving unit 6 drives the chamber 3 through an output shaft of the driving unit 6 and by means of the eccentric member (or alternatively by means of the connecting rod member), so that the volume of the chamber 3 changes along with rotation of the output shaft of the driving unit 6. However, it should be noted that, in principle, any type of driving device that causes a wall 9 of the chamber 3 to deform for volume changes can be used in the air pressure massager 1. The driving device can, for example, be performed hydraulically, pneumatically, mechanically or electromagnetically. An example is described in detail below.

The control device turns on the driving unit 6, and the driving unit 6 drives the eccentric member 4 to move to drive the connecting rod member 5 to move, such that a volume of the chamber 3 is changed to generate a pressure field for stimulating the human body. There is no gap between the chamber 3 and the connecting rod member, which is convenient for cleaning and maintenance, and solves the hygiene problem. The single chamber 3 ensures an integrity of the structure, thereby improving an overall waterproof performance. The pressure field generated by the single chamber 3 is configured to directly act on the human body, and there is no intermediate conduction energy loss, such that an excellent experience is obtained.

Furthermore, the air pressure massager 1 further comprises the housing 8. The housing 8 comprises a second opening 83. A main body of the chamber 3 extends into the housing 8 through the second opening 83 of the housing 8. Optionally, a design of the housing 8 conforms to an ergonomic form, so that the housing 8 can be comfortably held by one hand and has no sharp edges or sharp edges.

The air pressure massager 1 further comprises the accessory 18. Optionally, the accessory 18 is a portion of the housing 8 and is able to be moved relative to the housing 8 accommodating the pressure field generating device 2.

Furthermore, the chamber 3 may be made of a soft rubber material, such as a silicone material. For example, the chamber 3 is made of silicone film that made of the silicone material, which is convenient for contacting the skin area of the human body to be stimulated. The rotation of the eccentric member 4 drives the connecting rod member 5 to pull the silicone film, so that the volume of the chamber 3 made by the silicone film changes, and a movement stroke is 5 mm, thereby generating a pressure field for stimulation, which has a good stimulation effect and is convenient to use.

Further, a size of the first opening 31 is φ12.5 mm, which is reasonable in size and fits and stimulates the human body well.

Figure 5:
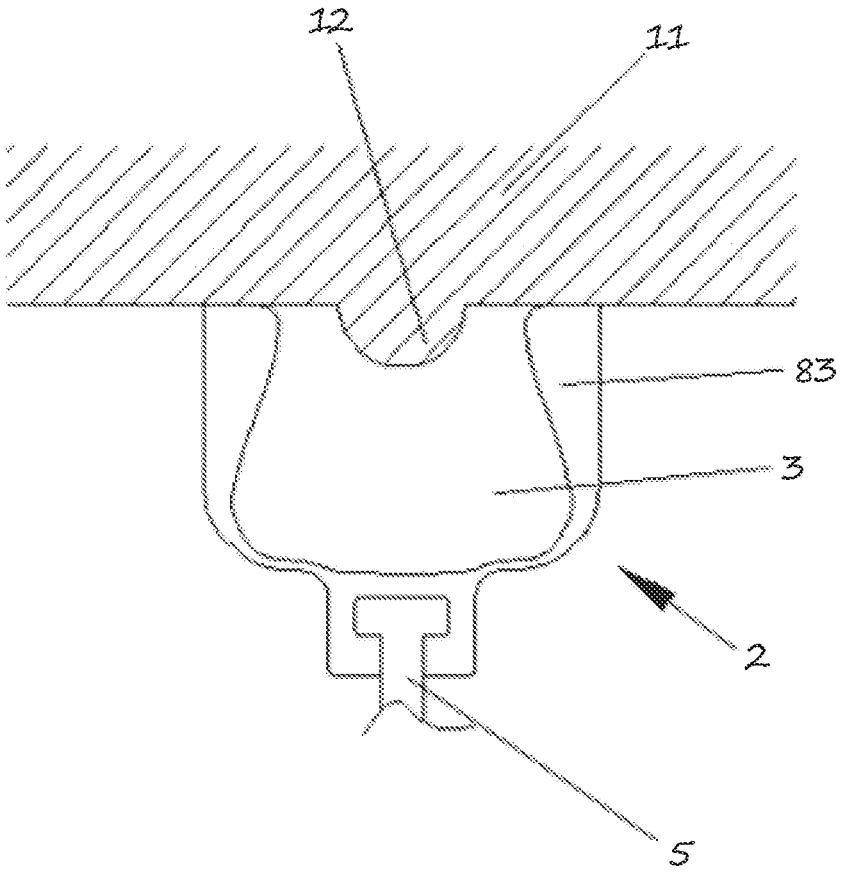
FIG. 5 is a cross-sectional view of a pressure field generating device where the air pressure massager of the present disclosure is in a first state.
Figure 6:
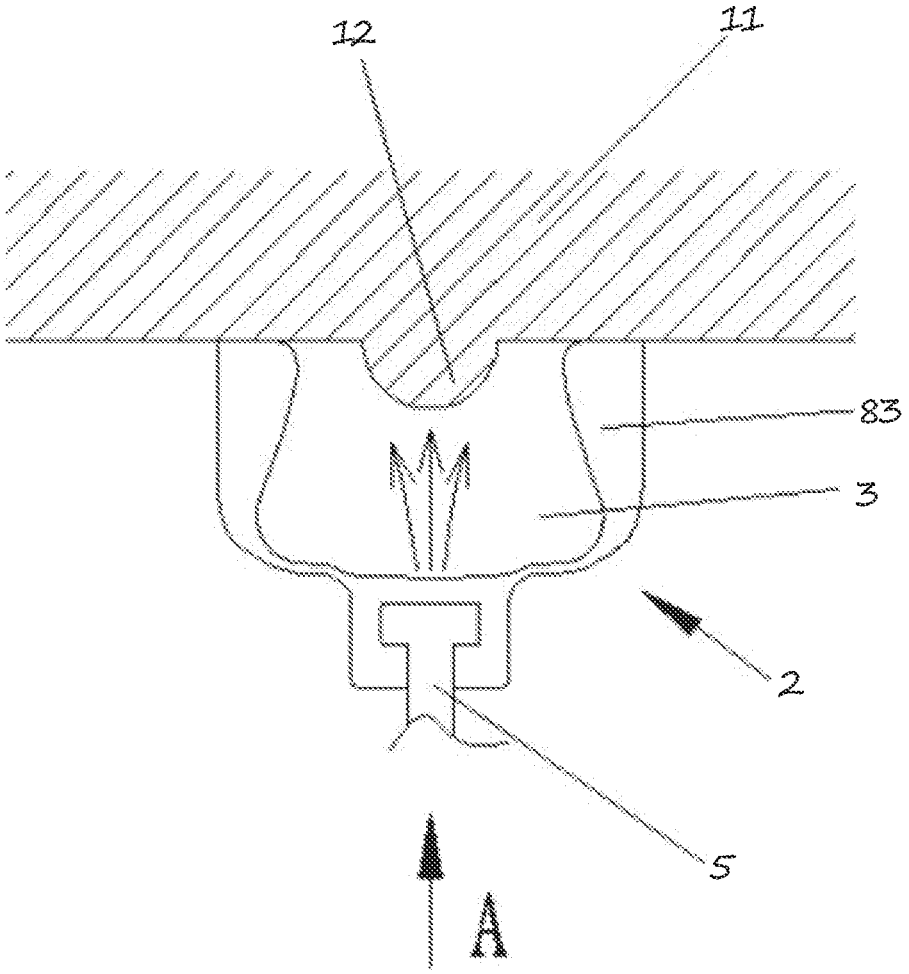
FIG. 6 is a cross-sectional view of the pressure field generating device where the air pressure massager of the present disclosure is in a second state.

The structure and function of a first aspect of the pressure field generating device 2 of the air pressure massager 1 will be described in detail below with reference to FIGS. 5-7. FIG. 5 is a cross-sectional view of a pressure field generating device where the air pressure massager of the present disclosure is in a first state. FIG. 6 is a cross-sectional view of the pressure field generating device where the air pressure massager of the present disclosure is in a second state. FIG.

7 is a cross-sectional view of the pressure field generating device where the air pressure massager of the present disclosure is in a third state.

FIG. 5 shows the pressure field generating device 2 in the first state, in which the chamber 3 is placed on the skin area or the portion of the human body 11 to be stimulated. The first state of the pressure field generating device 2 is demonstrated by a neutral deformation of the chamber 3.

The portion of the human body 11 to be stimulated is an area of the skin on the body. In the embodiment, the portion of the human body 11 is the clitoris 12, which is particularly sensitive. However, the use of the present disclosure is not limited to the clitoris 12. On the contrary, the air pressure massager 1 can be applied to any portion of the human body 11 or erogenous zones (such as inner thigh, waist area, nape, nipples, etc.) that can be stimulated by means of medium, air-pressure massage and/or negative pressure.

Since the chamber 3 is placed on the portion of the human body 11 to be stimulated, the chamber 3 is, to a large extent or completely isolated from an outside of the pressure field generating device 2. That is, the pressure field generating device 2 is connected with the chamber 3 through connecting rod member, in which an edge of the chamber 3 and a surface of the portion of the human body 11 ideally form an air-tight enclosure.

FIG. 6 shows the pressure field generating device 2 in the second state, in which the chamber 3 is placed on the skin area or the portion of the human body 11 to be stimulated. When in the second state, a force A acting on the chamber 3 causes the volume of the chamber 3 to decrease or compress. To be specific, a direction of force A is opposite to a direction of force B and the force A deforms the wall 9 of the chamber 3, so that the resulting volume V3 of the chamber 3 is smaller than the volume V1 (V1 is the volume of the chamber 3 where the pressure generating device is in the first state). The compression of the chamber 3 results in a positive pressure in the chamber 3.

The flow of the medium is limited by the first opening 31 and is now directed towards the portion of the human body 11 to be stimulated, in particular towards the clitoris glans of the clitoris 12. The indirect (pressure) massage occurs due to the flow of the medium onto the portion of the human body 11. In this embodiment, the size of the first opening 31 is set to be sufficiently small relative to the change of the volume in the chamber 3, so that the medium is sufficiently accelerated for a noticeable massage effect.

Furthermore, this type of medium is not only affected by the size and orientation of the first opening 31 but also affected by the connecting rod member 5. For example, the movement of the connecting rod member 5 makes the medium to rotate, so that the medium is distributed on the portion of the human body 11 to be stimulated to produce a "softer" or more turbulent effect.

Figure 7:
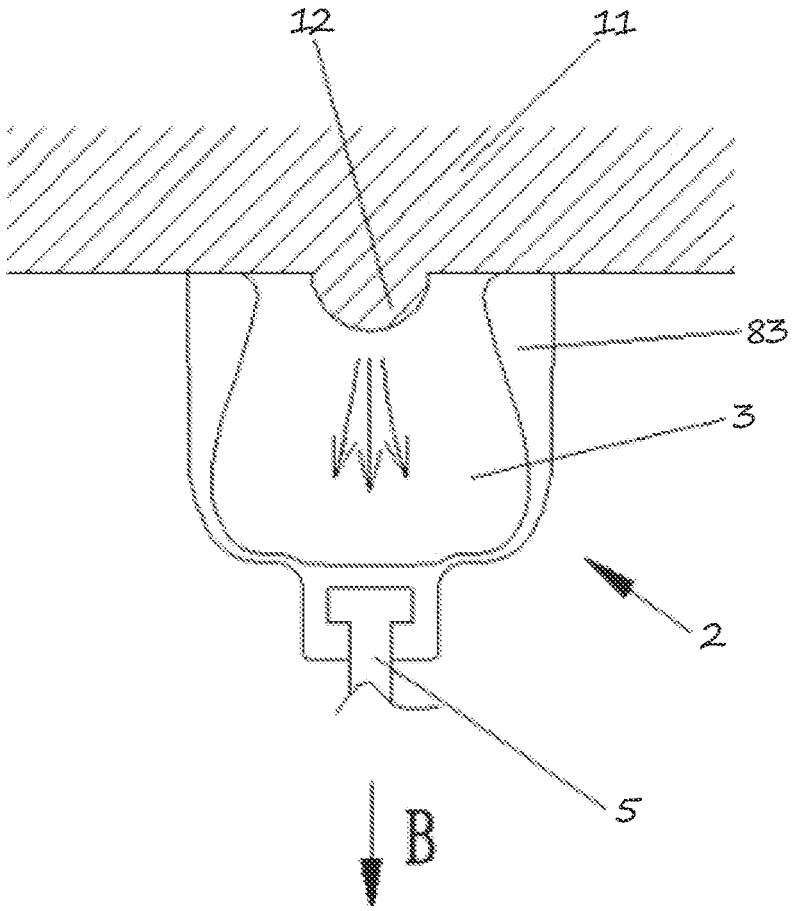
FIG. 7 is a cross-sectional view of the pressure field generating device where the air pressure massager of the present disclosure is in a third state.

FIG. 7 shows the pressure field generating device 2 in the third state, in which the chamber 3 is placed on the skin area or the portion of the human body 11 to be stimulated. When in the third state, the force B acting on the chamber 3 makes the volume of the chamber 3 to expand. To be specific, the force B pulls the wall 9 of the chamber 3 along a direction away from the chamber 3, which increases the volume of the chamber 3, so that the resulting volume V2 of the chamber 3 is greater than the volume V1. that is, V2>V1. The compression of the chamber 3 results in a positive pressure in the chamber 3. In order to equalize the pressure difference formed between the chamber 3 and the medium/air, the medium/air flows into a lower end of the chamber 3.

Assuming that in the first state, the pressure in the chamber 3 corresponds to the current external reference pressure (for example, air pressure), an overall pressure in the chamber is lower than the external reference pressure in the second state. The negative pressure is set to be lower than the normal systolic pressure in the blood vessels of the portion of the human body 11. The blood circulation in this area is therefore increased. In the embodiment, the clitoris 12 is better supplied with blood in the second state.

The pressure generating device 2 shown in FIGS. 5-7 has advantages that it is easy to clean from a hygienic point of view (because dead space is avoided) and simple to manufacture. For example, there is no need to disposed any valve or any other openings on the chamber 3.

Furthermore, as shown in FIGS. 1-3, the first opening 31 of the chamber 3 is disposed on the second opening 83 of the housing 8, which facilitates installation and fixation between the chamber 3 and the housing 8 and stabilizes the first opening 31 of the chamber 3, thereby facilitating the contact between the first opening 31 of the chamber 3 and the portion of the human body 11 and improving the effect of stimulation.

In one optional embodiment, as shown in FIGS. 1-3, the driving unit 6 comprises a first motor 61 fixedly disposed in the housing 8 and a power source 62 fixedly disposed in the housing 8. The power source 62 is connected to the first motor 61. Output shafts disposed on two ends of the first motor 61 are in the transmission connection with the eccentric member 4.

By fixing the first motor 61 in the housing 8, the first motor 61 is stable during operation, so that vibration is reduced, and no noise is generated. The first motor 61 is electrically connected with the power source 62 and a control board 71. The power source 62 provides power for the first motor 61, and the control board 71 controls a rotation and steering of the first motor 61. In this way, the eccentric member 4 that is in the transmission connection with two ends of the first motor 61 is controlled to rotate, and then the eccentric member 4 drives the connecting rod member 5 to move. The connecting rod member 5 changes the volume of the chamber 3 during the movement, so that the pressure field is generated for stimulation.

In one embodiment, the power source 62 is a battery or an external power supply 62. The power source 62 is configured to provide power for the first motor Furthermore, the eccentric member 4 comprises eccentric wheels 41 and perforated rubber rods 42. One end of each eccentric wheel 41 is connected to a corresponding output shaft disposed on one end of the first motor 61. One end of each perforated rubber rod 42 is connected to another end of each eccentric wheel 41. Another end of each perforated rubber rod 42 is connected to the connecting rod member 5.

In the embodiment, the first motor 61 rotates at both ends, which facilitates the rotation of the eccentric wheels 41 at both ends, thereby driving the connecting rod member 5 to move.

Specifically, the first motor 61 is driven to drive the eccentric wheels 41 at two ends of the first motor 61 to rotate, thereby driving the perforated rubber rods 42 to rotate. Since the one end of each perforated rubber rod 42 is connected to the connecting rod member 5, and the perforated rubber rods 42 drives the connecting rod member 5 to move during the rotation of the eccentric wheels 41, so that the volume of the chamber 3 changes during the movement of the connecting rod member 5. The pressure field generated by the change of the volume of the chamber 3 is used for stimulation, and the stimulation effect is good.

Furthermore, the connecting rod member 5 comprises a U-shaped rod 51 and a T-shaped rod 52. Two ends of the U-shaped rod 51 are separately connected to a corresponding perforated rubber rod 42. The T-shaped rod 52 is disposed on the U-shaped rod 51. A front end of the T-shaped rod 52 is connected to the chamber 3.

Figure 4:
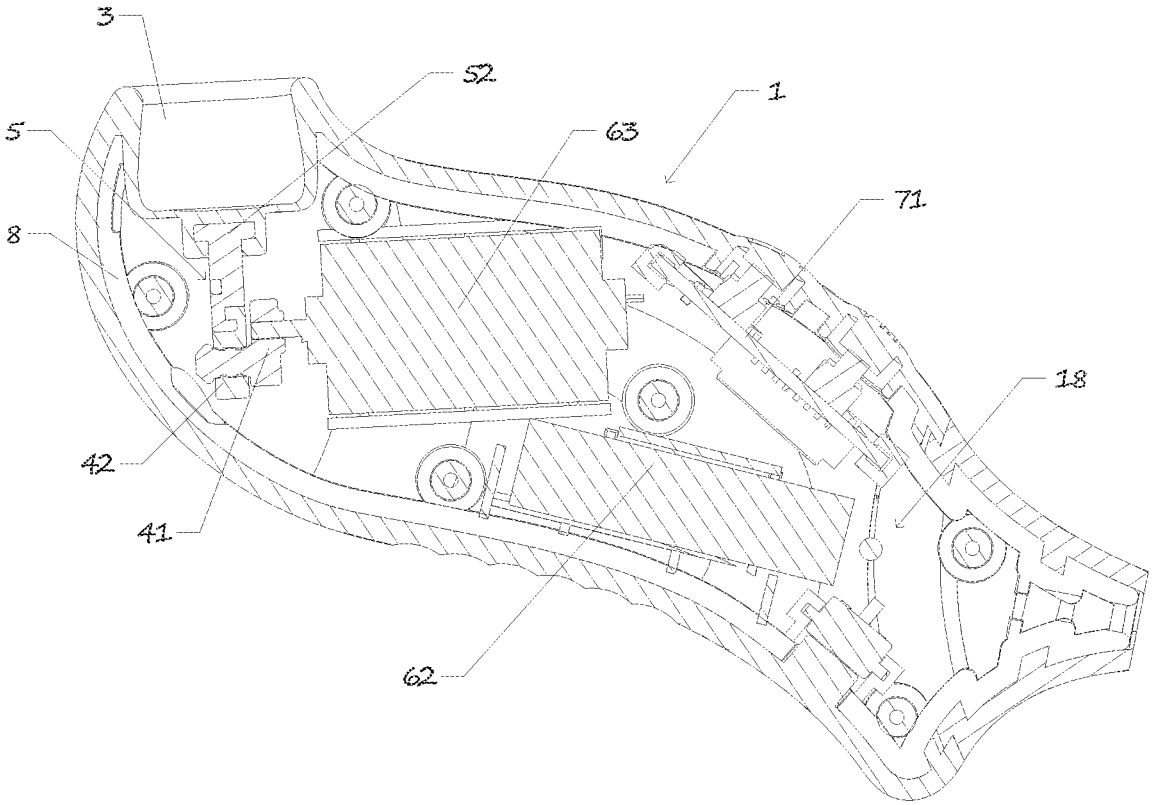
FIG. 4 is a cross-sectional view of a second embodiment of the air pressure massager of the present disclosure.

A second embodiment of tee present disclosure will be described with reference to FIG. 4. FIG. 4 is a cross-sectional view of the second embodiment of the air pressure massager of the present disclosure.

In one optional embodiment, the driving unit 6 comprises a second motor 63 and a power source 62. The second motor 63 is fixedly disposed in the housing 8. The power source 62 is fixedly disposed in the housing 8. The power source is connected to the second motor 63. An output shaft of the second motor 63 is in the transmission connection with the eccentric member 4

By fixing the second motor 63 in the housing 8, the second motor 63 is stable during operation, so that vibration is reduced, and no noise is generated. The second motor 63 is electrically connected with the power source 62 and the control board 71. The power source 62 provides power for the second motor 63, and the control board 71 controls a rotation and steering of the second motor 63. In this way, the eccentric member 4 that is in the transmission connection with an output end of second motor 63 is controlled to rotate, and then the eccentric member 4 drives the connecting rod member 5 to move. The connecting rod member 5 changes the volume of the chamber 3 during the movement, so that the pressure field is generated for stimulation.

Furthermore, the eccentric member 4 comprises an eccentric wheel 41 and a perforated rubber rod 42. One end of the eccentric wheel 41 is connected to the output shaft of the second motor 63. One end of the perforated rubber rod 42 is connected to another end of the eccentric wheel 41. Another end of the perforated rubber rod 42 is connected to the connecting rod member 5. Furthermore, the connecting rod member 5 is a T-shaped rod 52. A front end of the T-shaped rod 52 is connected to the chamber 3.

The second motor 63 is driven to drive the eccentric wheel 41 to rotate, thereby driving the perforated rubber rods 42 to rotate. Since one end of the perforated rubber rod 42 is connected to the connecting rod member 5, and the perforated rubber rods 42 drives the connecting rod member 5 to move during the rotation of the eccentric wheels 41.

Since the eccentric wheel 41 is disposed on the output shaft of the second motor 63, in order to facilitate the connection of the connecting rod member 5 with the eccentric wheel 41, the T-shaped rod 52 is connected with the perforated rubber rod 42 disposed on the eccentric wheel 41. A telescopic movement of the T-shaped rod 52 is adjusted by the rotation of the eccentric wheel 41, so that the volume of the chamber 3 changes and the pressure field generated is used for stimulation. The stimulation effect is good and the user experience effect is good.

Furthermore, as shown in FIG. 2, the air pressure massager 1 further comprises charging nails 16. The charging nails 16 are disposed in a lower portion of the housing 8 and are connected to the power source 62. By fitting the charging nails 16 into the housing 8 tightly, remaining electronic components of the sir pressure massager are connected by wire soldering, and the conductive effect is good. The charging nails 16 facilitates charging of the power source 62, which increases an endurance capability of the first motor 61. Meanwhile, the power source may be a battery disposed in the housing 8, such that the sir pressure massager is convenient for carrying and using.

Furthermore, as shown in FIG. 2, the power source 62 is a battery or an external power source 62 or the like. The charging effect is good, the battery life is strong, and the use effect is good.

Furthermore, the air pressure massager 1 further comprises a bracket 10. The drive unit 6 and the eccentric member 4 are disposed on the bracket 10. The drive unit 6 and the eccentric member 4 are connected together and then disposed on the bracket 10. The bracket 10 is fixed in the housing 8 by self-tapping screws, so that the air pressure massager has a high overall assembly efficiency and is convenient to use.

Furthermore, as shown in FIG. 2, the housing 8 comprises a lower housing 81 and an upper housing 82 disposed on the lower housing 81. The lower housing 81 is connected with the upper housing 82 through self-tapping screws. The bracket 10 is fixed in the upper housing 82 by screws.

The lower housing 81 and the upper housing 82 are made of plastic, which have high strength and have a light weight.

Specifically, by disposing the upper housing 82 on the lower housing 81, and by fixing the lower housing 81 and the upper housing 82 through self-tapping screws, the lower housing 81 and the upper housing 82 are fixed well. The bracket 10 is fixed in the upper housing 82 by screws, so that the bracket 10 and the upper shell 82 are fixed well. The bracket 10 has a strong supporting capacity and is convenient to use.

Furthermore, as shown in FIG. 2, the air pressure massager 1 further comprises an electroplating decoration piece 17. The electroplating decoration piece 17 is disposed under the housing 8 and is buckled with the housing 8. The electroplating decoration piece 17 decorates a bottom portion of the lower housing 81, and also plays a supporting effect. Since an assembly of the electroplating decoration piece 17 is directional, it is convenient to buckle the electroplating decoration piece 17 with the lower housing 81, and the assembly is convenient.

Furthermore, the air pressure massager is a handheld device. The user can hold the air pressure massager to find a suitable portion of the human body 11, which improves the stimulation effect on the clitoris 12.

Furthermore, the chamber 3 is made of flexible material and/or is made of at least partially transparent material. The chamber is selected from a labia minora shaped chamber so that the labia minora of the human body is completely covered by the first opening 31 of the chamber 3. When the chamber 3 contacts the clitoris 12, it feels soft and comfortable and would not cause damage during use, which is highly safe.

Furthermore, a rubber sleeve 13 is sleeved on the housing 8. The rubber sleeve 13 is configured to seal and fix the housing to prevent water from entering the housing 8. The rubber sleeve 13 has high waterproof performance, safety and sanitation.

In one embodiment, the rubber sleeve is integrally connected with the chamber.

Optionally, the rubber sleeve 13 completely wraps the housing 8. The sealing effect of the housing 8 is good, the structural is strong. The service life of the present disclosure is increased.

Furthermore, as shown in FIGS. 1-3, the rubber sleeve 13 comprises an auxiliary stimulation structure 14 disposed on an outer periphery of the first opening. The auxiliary stimulation structure 14 increases an effect of auxiliary stimulation, which makes the user experience good.

Furthermore, the rubber sleeve 13 and the chamber 3 may be an integral structure, so that the sealing effect is good. Or, the rubber sleeve 13 and the chamber 3 may be separated from each other, which is convenient for maintenance or replacement.

Furthermore, the auxiliary stimulation structure 14 is one or more layers of petal-shaped structures 15 formed on the outer periphery of the second opening 83. With one or more petal-shaped structures 15 on the outer periphery of the first opening 31, the effect of auxiliary stimulation is good and the present disclosure is widely used.

Furthermore, the chamber 3 and the connecting rod member 5 are made in one piece, so that a connection between the chamber 3 and the connecting rod member 5 is good. When the driving unit 6 is turned on, the eccentric member 4 is driven by the driving unit t6 to drive the connecting rod member 5 to move to change the volume of the chamber 3, so that the pressure field is generated by change of the volume of the chamber 3 for stimulating the human body. There is no gap between the chamber 3 and the connecting rod member 5, which is convenient for cleaning and maintenance, and solves the hygiene problem; The single chamber 3 ensures an integrity of the structure, thereby improving an overall waterproof performance. The pressure field generated by the single chamber is configured to directly act on the human body, and there is no intermediate conduction energy loss, such that an excellent experience is obtained.

Furthermore, the chamber 3 is replaceable, which is convenient for cleaning or replacement, and is safe and sanitary.

Figure 8:
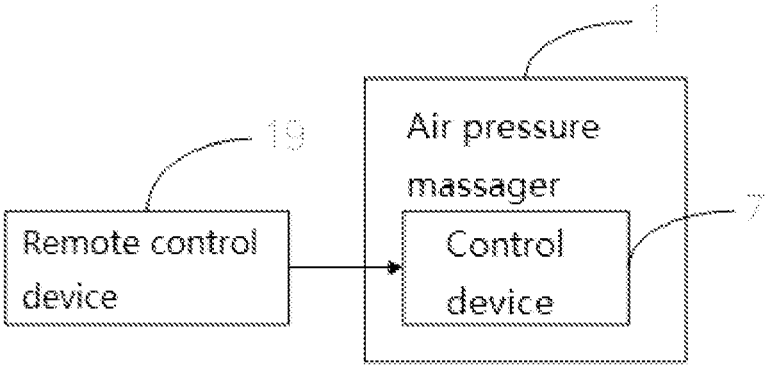
FIG. 8 is a block diagram of the air pressure massage system of the present disclosure.

The present disclosure further provides an air pressure massage system. As shown in FIG. 8, the air pressure massage system comprises an air pressure massager 1 and a remote control device 19. The air pressure massager 1 comprises at least one pressure field generating device 2. The pressure field generating device 2 comprises a chamber 3 with at least one first opening 31, a connecting rod member 5 connected to one end of the chamber 3, an eccentric member 4 connected to the connecting rod member 5, a driving unit 6 in a transmission connection with the eccentric member 4, a control device 7 configured to activate the drive unit 6, and an accessory 18. The first opening 31 is configured to be placed on a portion of a human body 11. The driving unit 6 drives the eccentric member 4 to move to drive the connecting rod member 5 to move, such that a volume of the chamber 3 is changed to generate a pressure field for stimulating the human body. The pressure field generated in the chamber 3 directly towards the portion of the human body. The pressure field is adjusted by a positive pressure mode and/or a negative pressure mode. The remote control device 19 is disposed separately from the air pressure massager 1. The control device 7 of the air pressure massager 1 is remotely controlled by the remote control device 19.

The present disclosure further provides a method for stimulating a portion of a human body based on an air pressure massager. The air pressure massager 1 comprises at least one pressure field generating device 2. The pressure field generating device 2 comprises a chamber 3 with at least one first opening 31, a connecting rod member 5 connected to one end of the chamber 3, an eccentric member 4 connected to the connecting rod member 5, a driving unit 6 in a transmission connection with the eccentric member 4, a control device 7 configured to activate the drive unit 6, and an accessory 18. The first opening 31 is configured to be placed on a portion of a human body 11. The driving unit 6 drives the eccentric member 4 to move to drive the connecting rod member 5 to move, such that a volume of the chamber 3 is changed to generate a pressure field for stimulating the human body. The pressure field generated in the chamber 3 directly towards the portion of the human body. The pressure field is adjusted by a positive pressure mode and/or a negative pressure mode.

The method for stimulating the portion of the human body based on the air pressure massager comprises steps:

placing a chamber of the air pressure massager on the portion of the human body;

generating a pressure field directly towards the portion of the human body 11; and adjusting the pressure field in a positive pressure mode or a negative pressure mode.

The present disclosure further provides an application of an air pressure massager. The air pressure massager is used as a sex toy for stimulating female clitoris 12. The air pressure massager 1 comprises at least one pressure field generating device 2. The pressure field generating device 2 comprises a chamber 3 with at least one first opening 31, a connecting rod member 5 connected to one end of the chamber 3, an eccentric member 4 connected to the connecting rod member 5, a driving unit 6 in a transmission connection with the eccentric member 4, a control device 7 configured to activate the drive unit 6, and an accessory 18. The first opening 31 is configured to be placed on a portion of a human body 11. The driving unit 6 drives the eccentric member 4 to move to drive the connecting rod member 5 to move, such that a volume of the chamber 3 is changed to generate a pressure field for stimulating the human body. The pressure field generated in the chamber 3 directly towards the portion of the human body. The pressure field is adjusted by a positive pressure mode and/or a negative pressure mode.

The above descriptions are only optionally embodiments of the present disclosure and are not intended to limit the present invention. Any modification, equivalent replacement, and improvement made within the spirit and principle of the present disclosure shall be included in the protection of the present disclosure.

What is claimed is:

1. An air pressure massager, comprising at least one pressure field generating device; wherein the at least one pressure field generating device comprises:

a chamber with at least one first opening; wherein the at least one first opening is configured to be placed on a portion of a human body;

a connecting rod member connected to one end of the chamber;

an eccentric member connected to the connecting rod member;

a driving unit in a transmission connection with the eccentric member;

a control device configured to activate the driving unit; and an accessory;

wherein the driving unit drives the eccentric member to move to drive the connecting rod member to move, such that a volume of the chamber is changed to generate a pressure field for stimulating the human body; the pressure field generated in the chamber directly towards the portion of the human body; a direction of the pressure field is adjusted by positive pressure and/or negative pressure;

wherein the driving unit comprises a motor; output shafts, each output shaft disposed respectively on two ends of the motor and is in the transmission connection with the eccentric member; the eccentric member comprises eccentric wheels and perforated rubber rods; one end of each eccentric wheel is connected to the corresponding output shaft disposed on one end of the motor; one end of each perforated rubber rod is connected to another end of each eccentric wheel; another end of each perforated rubber rod is connected to the connecting rod member.

2. The air pressure massager according to claim 1, wherein the air pressure massager further comprises a housing; the housing comprises a second opening; a main body of the chamber extends into the housing through the second opening of the housing.

3. The air pressure massager according to claim 2, wherein the at least one first opening of the chamber is disposed in the second opening of the housing.

4. The air pressure massager according to claim 2, wherein the driving unit comprises a power source fixedly disposed in the housing; the motor is fixedly disposed in the housing; the power source is connected to the first motor.

5. The air pressure massager according to claim 4, wherein the connecting rod member comprises a U-shaped rod and a T-shaped rod;

wherein two ends of the U-shaped rod are separately connected to the corresponding perforated rubber rod;

wherein the T-shaped rod is disposed on the U-shaped rod; a front end of the T-shaped rod is connected to the chamber.

6. The air pressure massager according to claim 2, wherein the air pressure massager further comprises charging nails; the charging nails are disposed in a lower portion of the housing and are connected to a power source.

7. The air pressure massager according to claim 6, wherein the power source is a battery.

8. The air pressure massager according to claim 2, wherein the air pressure massager further comprises a bracket; the driving unit and the eccentric member are disposed on the bracket.

9. The air pressure massager according to claim 2, wherein the air pressure massager further comprises an electroplating decoration piece; the electroplating decoration piece is disposed under the housing and is buckled with the housing.

10. The air pressure massager according to claim 1, wherein the air pressure massager is a handheld device.

11. The air pressure massager according to claim 2, wherein the chamber is made of flexible material and/or is made of at least partially transparent material; wherein the chamber is selected from a labia minora shaped chamber so that a labia minora of the human body is completely covered by the at least one first opening.

12. The air pressure massager according to claim 11, wherein a rubber sleeve is sleeved on the housing.

13. The air pressure massager according to claim 12, wherein the rubber sleeve is integrally connected with the chamber.

14. The air pressure massager according to claim 13, wherein the rubber sleeve comprises an auxiliary stimulation structure disposed on an outer periphery of the at least one first opening.

15. The air pressure massager according to claim 14, wherein the auxiliary stimulation structure is one or more layers of petal-shaped structures formed on an outer periphery of the second opening.

16. The air pressure massager according to claim 1, wherein the chamber and the connecting rod member are made in one piece.

17. The air pressure massager according to claim 1, wherein the chamber is replaceable.

18. An air pressure massage system, comprising an air pressure massager and a remote control device; wherein the air pressure massager comprises:

at least one pressure field generating device, wherein the at least one pressure field generating device comprises:

a chamber with at least one first opening; wherein the at least one first opening is configured to be placed on a portion of a human body;

a connecting rod member connected to one end of the chamber;

an eccentric member connected to the connecting rod member;

a driving unit in a transmission connection with the eccentric member;

a control device configured to activate the driving unit; and an accessory;

wherein the driving unit drives the eccentric member to move to drive the connecting rod member to move, such that a volume of the chamber is changed to generate a pressure field for stimulating the human body; the pressure field generated in the chamber directly towards the portion of the human body; a direction of the pressure field is adjusted by positive pressure and/or negative pressure;

wherein the driving unit comprises a motor; output shafts, each output shaft disposed respectively on two ends of the motor and is in the transmission connection with the eccentric member; the eccentric member comprises eccentric wheels and perforated rubber rods; one end of each eccentric wheel is connected to the corresponding output shaft disposed on one end of the motor; one end of each perforated rubber rod is connected to another end of each eccentric wheel; another end of each perforated rubber rod is connected to the connecting rod member;

wherein the remote control device is disposed separately from the air pressure massager;

wherein the control device of the air pressure massager is remotely controlled by the remote control device.

19. A method for stimulating a portion of a human body based on an air pressure massager, comprising:

placing a chamber of the air pressure massager on the portion of the human body;

generating a pressure field directly towards the portion of the human body; and adjusting the pressure field in positive pressure or negative pressure;

wherein the air pressure massager comprises:

at least one pressure field generating device, wherein the at least one pressure field generating device comprises:

the chamber with at least one first opening; wherein the at least one first opening is configured to be placed on the portion of the human body, a connecting rod member connected to one end of the chamber;

an eccentric member connected to the connecting rod member;

a driving unit in a transmission connection with the eccentric member;

a control device configured to activate the driving unit; and an accessory;

wherein the driving unit drives the eccentric member to move to drive the connecting rod member to move, such that a volume of the chamber is changed to generate the pressure field for stimulating the human body; the pressure field generated in the chamber directly towards the portion of the human body; a direction of the pressure field is adjusted by the positive pressure and the negative pressure;

wherein the driving unit comprises a motor; output shafts, each output shaft disposed respectively on two ends of the motor and is in the transmission connection with the eccentric member; the eccentric member comprises eccentric wheels and perforated rubber rods; one end of each eccentric wheel is connected to the corresponding output shaft disposed on one end of the motor; one end of each perforated rubber rod is connected to another end of each eccentric wheel; another end of each perforated rubber rod is connected to the connecting rod member.

20. A method of stimulating female clitoris by applying an air pressure massager, comprising providing the air pressure massager used as a sex toy;

wherein the air pressure massager comprises at least one pressure field generating device, wherein the at least one pressure field generating device comprises:

a chamber with at least one first opening; wherein the at least one first opening is configured to be placed on a portion of the female clitoris;

a connecting rod member connected to one end of the chamber;

an eccentric member connected to the connecting rod member;

a driving unit in a transmission connection with the eccentric member a control device configured to activate the driving unit;

and an accessory;

wherein the driving unit drives the eccentric member to move to drive the connecting rod member to move, such that a volume of the chamber is changed to generate a pressure field for stimulating the female clitoris; the pressure field generated in the chamber directly towards the portion of the female clitoris; a direction of the pressure field is adjusted by positive pressure and/or negative pressure;

wherein the driving unit comprises a motor; output shafts, each output shaft disposed respectively on two ends of the motor and is disposed on two ends of the motor are in the transmission connection with the eccentric member; the eccentric member comprises eccentric wheels and perforated rubber rods; one end of each eccentric wheel is connected to the corresponding output shaft disposed on one end of the motor; one end of each perforated rubber rod is connected to another end of each eccentric wheel; another end of each perforated rubber rod is connected to the connecting rod member.

* * * * *